US007363696B2

(12) United States Patent
Kimura et al.

(10) Patent No.: US 7,363,696 B2
(45) Date of Patent: Apr. 29, 2008

(54) METHOD OF ASSEMBLING A SEALED TYPE MOTOR-DRIVEN COMPRESSOR

(75) Inventors: Kazuya Kimura, Kariya (JP); Izuru Shimizu, Kariya (JP); Takeshi Kawata, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 444 days.

(21) Appl. No.: 10/993,595

(22) Filed: Nov. 19, 2004

(65) Prior Publication Data

US 2005/0115055 A1 Jun. 2, 2005

(30) Foreign Application Priority Data

Nov. 21, 2003 (JP) ..... 2003-392357

(51) Int. Cl.
*H02K 15/00* (2006.01)

(52) U.S. Cl. ..... 29/596; 29/598; 29/732; 310/89; 310/216; 418/55.5; 418/57

(58) Field of Classification Search ..... 29/596, 29/598, 732; 310/89, 216; 418/55.5, 57
See application file for complete search history.

(56) References Cited

U.S. PATENT DOCUMENTS 6,217,297 B1 * 4/2001 Tsumagari et al. ..... 417/360
6,544,009 B2 4/2003 Makino et al. ..... 417/312
6,648,618 B2 * 11/2003 Nishiki et al. ..... 418/55.5

FOREIGN PATENT DOCUMENTS

| | | |
|---|---|---|
| EP | 1 139 542 | 10/2001 |
| JP | 03-151591 | 6/1991 |
| JP | 05-268740 | 10/1993 |
| JP | 2000-224787 | 8/2000 |
| JP | 2001-78385 | 3/2001 |
| JP | 2003-269335 | 9/2003 |

* cited by examiner

*Primary Examiner*—Tim Phan
(74) *Attorney, Agent, or Firm*—Morgan & Finnegan, L.L.P.

(57) ABSTRACT

A sealed type motor-driven compressor includes a cylindrical motor housing and an annular stator core fastened to the interior of the motor housing. A method of assembling the compressor includes fastening the stator core to the motor housing by mechanically deforming at least one of the motor housing and the stator core. It is thus possible to set the fastening interference between the motor housing and the stator core to a sufficiently great level for suppressing loosening of the stator core with respect to the motor housing, which may otherwise be caused by a relatively high pressure produced by refrigerant gas.

5 Claims, 4 Drawing Sheets

METHOD OF ASSEMBLING A SEALED TYPE MOTOR-DRIVEN COMPRESSOR

CROSS-REFERENCE TO RELATED DOCUMENTS

The present application claims priority to JAPAN Application No. 2003-392357, filed on Nov. 21, 2003.

BACKGROUND OF THE INVENTION

The present invention relates to assembly methods of a motor housing and a stator core of a sealed type motor-driven compressor.

In a sealed type motor-driven compressor, a sealed housing accommodates, for example, a scroll type compressor mechanism and an electrical motor for driving the mechanism. The motor includes a rotational shaft, a rotor, and a stator. The rotational shaft of the motor is rotationally supported at a middle portion of a motor housing, which forms part of the sealed housing. The rotor is securely fitted to the outer circumferential surface of the rotational shaft. The stator is securely fitted to the inner circumferential surface of the motor housing through shrink fitting. The stator includes a cylindrical stator core and coils arranged along the inner circumference of the stator core. A technique for shrink-fitting the stator to the motor housing is disclosed in, for example, Japanese Laid-Open Patent Publication Nos. 2000-224787 and 2003-269335.

When the motor housing is formed of aluminum, which has smaller modulus of elasticity than iron, a pressure rise in the motor housing causes a relatively great increase of the inner diameter of the motor housing, as compared to the case in which the motor housing is formed of iron. Chlorofluorocarbon or carbon dioxide is used as refrigerant gas charged in a refrigerating circuit of a vehicle air conditioner. The maximum charging pressure of chlorofluorocarbon gas is approximately 1 to 2 MPa, while that of carbon dioxide is equal to or greater than 10 MPa. As long as the pressure in the motor housing is maximally 1 to 2 MPa, the stator is prevented from loosening with respect to the motor housing by a fastening interference defined in shrink fitting of the stator core and the motor housing. However, if carbon dioxide is used as the refrigerant, the pressure equal to or greater than 10 MPa is applied to the motor housing.

Accordingly, if carbon dioxide is used as the refrigerant and the motor housing formed of aluminum is employed, the motor housing must have a relatively large wall thickness for preventing the increase of the inner diameter of the motor housing. However, this increases the dimensions and weight of the compressor. Alternatively, the shrink fitting of the stator core and the motor housing may be performed with a sufficiently large fastening interference such that an effective fastening interference is maintained even if the inner circumference of the motor housing is increased. However, to provide a sufficiently large fastening interference, the shrink fitting must be performed at a relatively high temperature, leading to lowering of the strength of the motor housing, which is formed of aluminum. It is thus extremely difficult to increase the fastening interference for the shrink fitting.

In contrast, if the motor housing is formed of iron, the increase of the inner diameter of the motor housing, which is caused by the high pressure applied by the refrigerant gas, is extremely small. However, the motor housing formed of iron increases the weight of the compressor.

SUMMARY OF THE INVENTION

Accordingly, it is an objective of the present invention to provide a novel assembly method of a motor housing and a stator core capable of providing a sufficiently large fastening interference between the motor housing and the stator core for suppressing loosening of the stator core with respect to the motor housing, which is otherwise caused by a relatively high pressure produced by refrigerant gas.

To achieve the foregoing and other objectives and in accordance with the purpose of the present invention, the invention provides a method of assembling a sealed type motor-driven compressor having a cylindrical motor housing and an annular stator core fastened to the interior of the motor housing. The method includes fastening the stator core to the motor housing by mechanically deforming at least one of the motor housing and the stator core.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
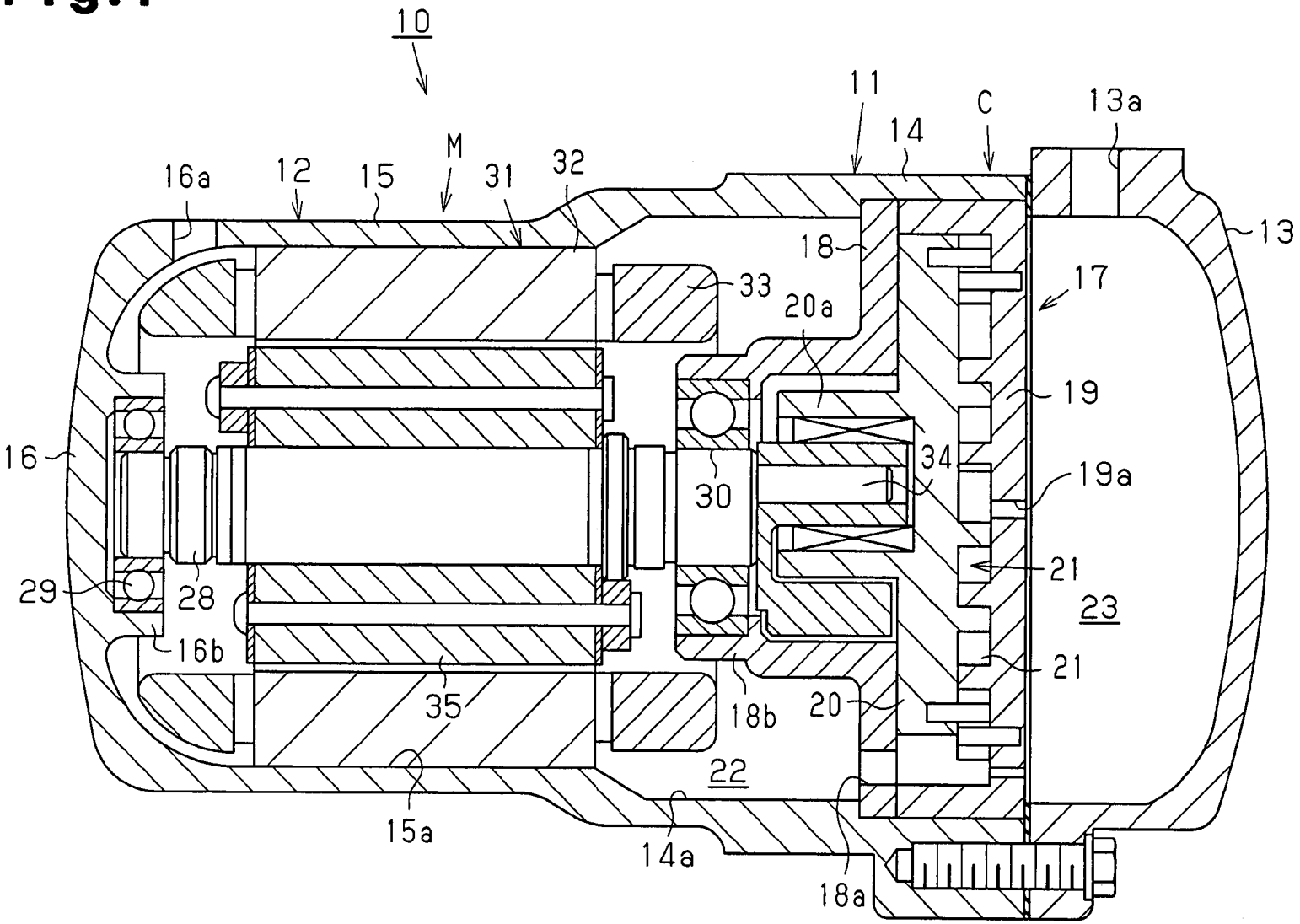
FIG. 1 is a longitudinal cross-sectional view showing an embodiment of a motor-driven compressor according to the present invention.

With reference to FIGS. 1 to 4, an embodiment of an assembly method of a stator core and a motor housing of a sealed type motor-driven compressor 10 according to the present invention will be described.

The compressor 10 includes a sealed housing 11 having a housing body 12 and a front housing 13. The housing body 12 is formed of aluminum through forging and has a lidded, horizontal cylindrical shape. The front housing 13 is securely connected to a front opening end (as viewed to the right in FIG. 1) of the housing body 12. The housing body 12 includes a compressor housing 14, a motor housing 15, and a rear housing 16 (as viewed to the left in FIG. 1). The compressor housing 14 is located in a front portion of the housing body 12. The motor housing 15 has a relatively small diameter and is formed integrally with a rear end of the compressor housing 14. The rear housing 16 is formed integrally with a rear end of the motor housing 15.

The compressor housing 14 accommodates a scroll type compressor mechanism 17. The mechanism 17 includes a base plate 18, a fixed scroll 19, and a revolving scroll 20. The base plate 18 is securely fitted to a stepped portion of an inner circumferential surface 14*a* of the compressor housing 14. The fixed scroll 19 is securely fitted to the inner circumferential surface of a front opening of the compressor housing 14. The revolving scroll 20 is arranged between the base plate 18 and the fixed scroll 19. A compression chamber 21 is defined by the fixed scroll 19 and the revolving scroll 20. Further, a suction chamber 22 is defined in the compressor housing 14 and at a rear side of the base plate 18.

A discharge chamber 23 is defined in the front housing 13. Refrigerant gas is drawn from the suction chamber 22 to the compression chamber 21 through a suction port 18*a*, which is defined in the base plate 18, and is compressed in the compression chamber 21. The refrigerant gas is then discharged to the discharge chamber 23 through a discharge port 19*a*, which is defined in the fixed scroll 19. The refrigerant gas is, for example, carbon dioxide.

An outlet 13*a* is defined in the front housing 13 for supplying the compressed refrigerant gas to an external refrigerating circuit. An inlet 16*a* is defined in the rear housing 16 for introducing the refrigerant gas from the external refrigerating circuit to the suction chamber 22.

A stator 31 is securely fitted to the inner circumferential surface of the motor housing 15, which forms part of an electrical motor M. The stator 31 includes a stator core 32, teeth 32*a*, and coils 33. The stator core 32 is formed of iron. The teeth 32*a* are formed on the inner circumference of the stator core 32 and the coils 33 are each wound around the corresponding one of the teeth 32*a*. A boss portion 16*b* is formed integrally with an inner rear side of the rear housing 16. Likewise, a boss portion 18*b* is formed integrally with the rear side of the base plate 18.

A rotary shaft 28 is rotationally supported by a pair of bearings 29, 30 between the boss portions 16*b*, 18*b*. An eccentric pin 34 is disposed at a distal end of the rotary shaft 28 and is connected to a boss portion 20*a*, which is formed integrally with a rear side of the revolving scroll 20, through a bearing. A rotor 35 is securely fitted to the outer circumferential surface of the rotary shaft 28.

When an alternating current is supplied from a non-illustrated power supply to the coils 33, electromagnetic attractive force is produced by the stator 31 and the rotor 35, such that the rotary shaft 28 is rotated. This revolves the eccentric pin 34, thus permitting the revolving scroll 20 to revolve in a state prohibited from rotating. In this manner, the compressor mechanism 17 compresses the refrigerant gas.

The main portion of the present invention will hereafter be described.

Figure 2:
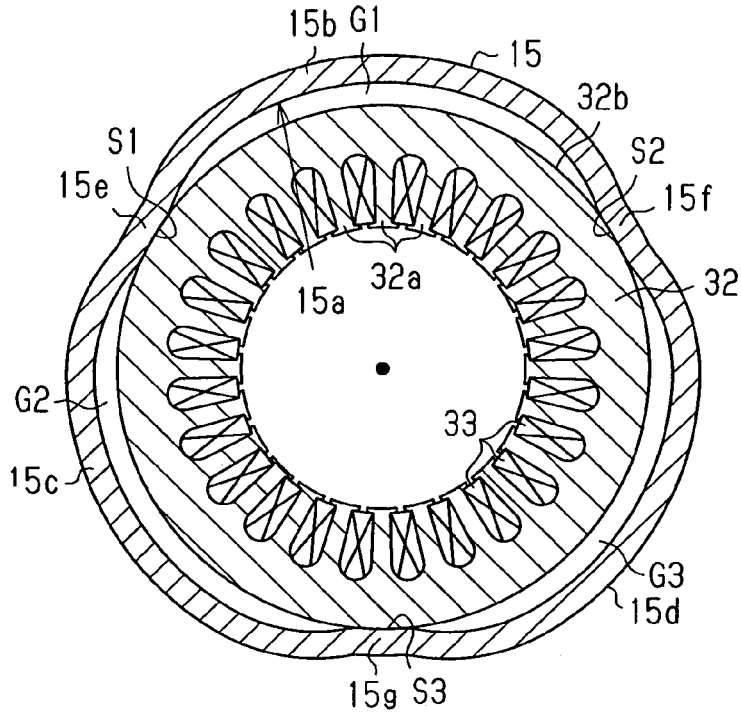
FIG. 2 is a partially omitted cross-sectional view showing a motor portion of the compressor of FIG. 1.

FIG. 2 is a lateral cross-sectional view showing the motor housing 15 and the stator core 32. In the illustrated embodiment, the motor housing 15 includes first, second, and third expanded portions 15*b*, 15*c*, 15*d* and first, second, and third fastening interference portions 15*e*, 15*f*, 15*g*. Each of the fastening interference portions 15*e* to 15*g* is formed integrally with the motor housing 15 and is arranged between the corresponding adjacent ones of the first to third expanded portions 15*b* to 15*d*. First, second, and third fastening surfaces S1, S2, S3 are each formed along the arched inner circumferential surface of the corresponding one of the first to third fastening interference portions 15*e* to 15*g*. The first to third fastening surfaces S1 to S3 are fastened to an outer circumferential surface 32*b* of the stator core 32 at three respective positions by a predetermined fastening force.

The stator core 32 is assembled with the motor housing 15 by the following method.

Figure 3:
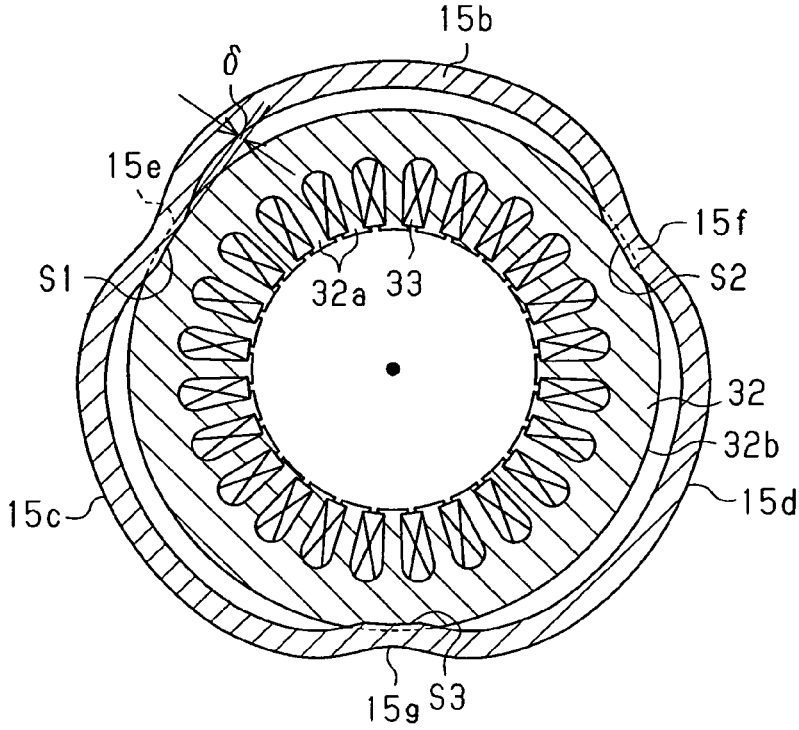
FIG. 3 is a cross-sectional view showing a fastening interference between a motor housing and a stator core before assembly.

FIG. 3 shows the state of the motor housing 15 and the stator core 32 before assembly. In this state, as viewed with respect to the axis of the stator core 32, the first to third fastening surfaces S1 to S3 of the first to third fastening interference portions 15*e* to 15*g* are located radially inward compared to the outer circumferential surface 32*b* of the stator core 32. The distance between the outer circumferential surface 32*b* of the stator core 32 and each of the fastening surfaces S1 to S3, as viewed with respect to the axis of the stator core 32, is defined as a fastening interference δ. In the illustrated embodiment, the fastening interference δ is set to, for example, 200 μm. The fastening interference of the motor housing 15 as a whole is set to $2\times\delta=400$ μm.

Figure 4:
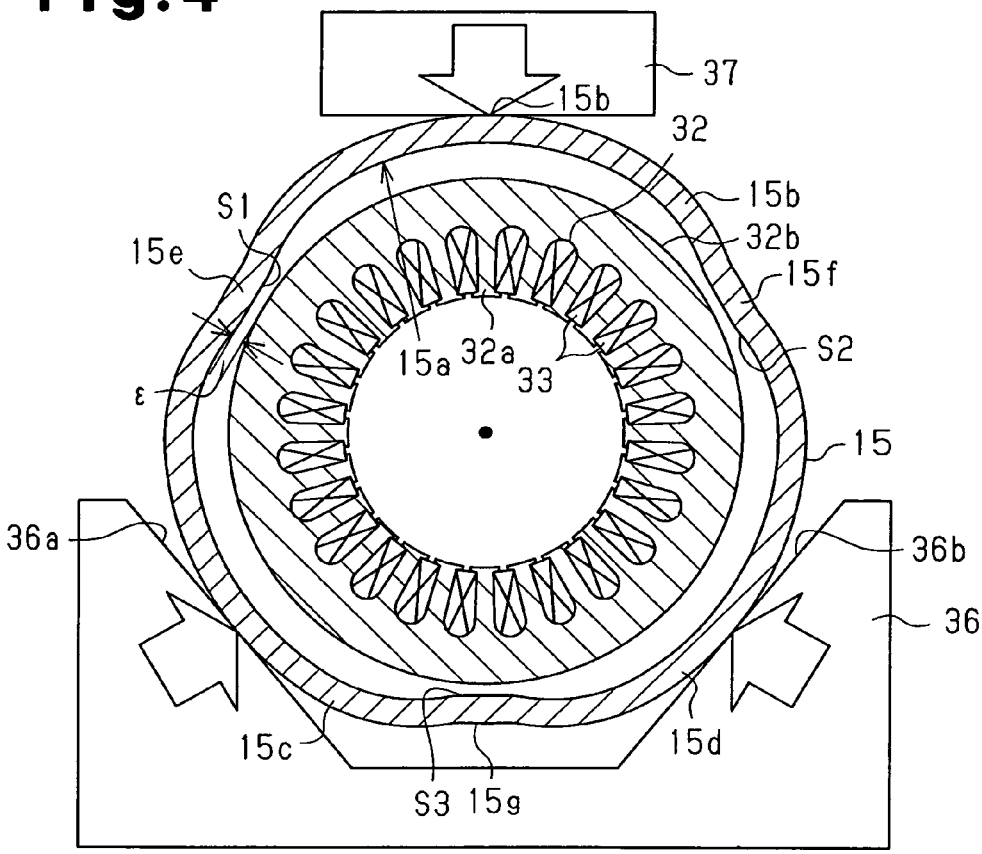
FIG. 4 is a cross-sectional view showing an elastically deformed state of the motor housing such that the stator core is fitted to the motor housing.

With reference to FIG. 4, the second and third expanded portions 15*c*, 15*d* are received by a lower pressing tool 36 having a pair of slanted support surfaces 36*a*, 36*b* at opposing sides. In this state, an upper pressing tool 37 presses the outer circumferential surface of the first expanded portion 15*b* downward, that is, radially inward. The lower and upper pressing tools 36 and 37 elastically deform the first to third expanded portions 15*b* to 15*d* such that the first to third fastening interference portions 15*e* to 15*g* are displaced radially outward.

Accordingly, referring to FIG. 4, the fastening surfaces S1 to S3 are spaced from the positions corresponding to the outer circumferential surface 32*b* of the stator core 32. Each of the resulting distances between the fastening surfaces S1 to S3 and the positions corresponding to the outer circumferential surface 32*b* of the stator core 32 is defined as fitting interference ϵ. Although it is theoretically possible to set the fitting interference ϵ to 0 μm, the fitting interference ϵ must be set to approximately 50 μm, in order to absorb manufacturing errors of the motor housing 15 and the stator core 32 and facilitate the assembly.

As illustrated in FIG. 4, the stator core 32 is then inserted into the motor housing 15 with the fitting interference ϵ maintained. In this state, pressing by the pressing tools 36, 37 is released, each of the first to third fastening interference portions 15*e* to 15*g* is restored to the original state by elastic shape-restoring force. Each fastening surface S1 to S3 is restored in accordance with the distance corresponding to the fitting interference ϵ because of the fastening interference δ. Each fastening surface S1 to S3 is thus securely fastened to the outer circumferential surface 32*b* of the stator core 32. In this manner, without using the shrink fitting, the stator core 32 is securely fastened to the motor housing 15.

A forming angle defined by the fastening surface S1 to S3 of each fastening interference portion 15*e* to 15*g* with respect to the center of the motor housing 15 in the circumferential direction is set to, for example, 5 to 30 degrees. If this forming angle is excessively small, the fastening interference portions 15*e* to 15*g* may be deformed. If the forming angle is excessively large, the predetermined fastening interference δ is hard to ensure. It is thus preferred that the forming angle is set to 10 to 20 degrees.

Referring to FIG. 2, in the state that the motor housing 15 is assembled with the stator core 32, clearances G1, G2, G3 are each defined between the inner circumferential surface of the corresponding one of the first to third expanded portions 15*b* to 15*d* and the outer circumferential surface 32*b* of the stator core 32. Each of the clearances G1 to G3 defines a passage for guiding the refrigerant gas drawn to the motor housing 15 through the inlet 16*a* to the suction chamber 22.

The refrigerant gas, which is carbon dioxide, sealed in the refrigerating circuit is introduced into the compressor 10. Thus, when the compressor 10 actually operates, a relatively high pressure exceeding 10 MPa is applied to the compressor 10. However, in the illustrated embodiment, the fastening interference 2δ of 400 μm is provided. Thus, even if the high pressure acting on the inner circumferential surface 15*a* of the motor housing 15 increases the inner diameter of the motor housing 15 such that the motor housing 15 loosens with respect to the stator core 32 by, for example, 147 μm, a sufficiently great fastening force is maintained between the stator core 32 and the motor housing 15.

The illustrated embodiment has the following advantages.

(1) In the illustrated embodiment, the first to third expanded portions 15*b* to 15*d* of the motor housing 15 are pressed radially inward from the outer side by using the pressing tools 36, 37. The fastening surfaces S1 to S3 of the first to third fastening interference portions 15*e* to 15*g* are thus displaced radially outward in accordance with the fastening interference δ and the fitting interference ϵ. As a result, each fastening surface S1 to S3 is slightly spaced from the position corresponding to the outer circumferential surface 32*b* of the stator core 32.

In this state, the stator core 32 is inserted into the motor housing 15 and the pressing tools 36, 37 are released. This allows the first to third fastening interference portions 15*e* to 15*g* to be pressed against the outer circumferential surface 32*b* of the stator core 32. It is thus possible to easily ensure the fastening interference δ larger than that of the shrink fitting or shrink cooling. Accordingly, without employing a complicated technique with the shrink fitting and the shrink cooling, the stator core 32 is securely fastened to the motor housing 15.

(2) In the illustrated embodiment, since carbon dioxide is used as refrigerant gas, a relatively high pressure is applied to the compressor 10, as compared to the case in which chlorofluorocarbon is employed. Further, the motor housing 15, to which the stator core 32 is fastened, can be formed of aluminum by forging at a relatively small wall thickness, for example, 4 mm. This reduces the weight of the compressor 10, as compared to the case in which the motor housing 15 is formed through casting and has a relatively large wall thickness.

The present invention may be embodied in the following modified forms.

Figure 5:
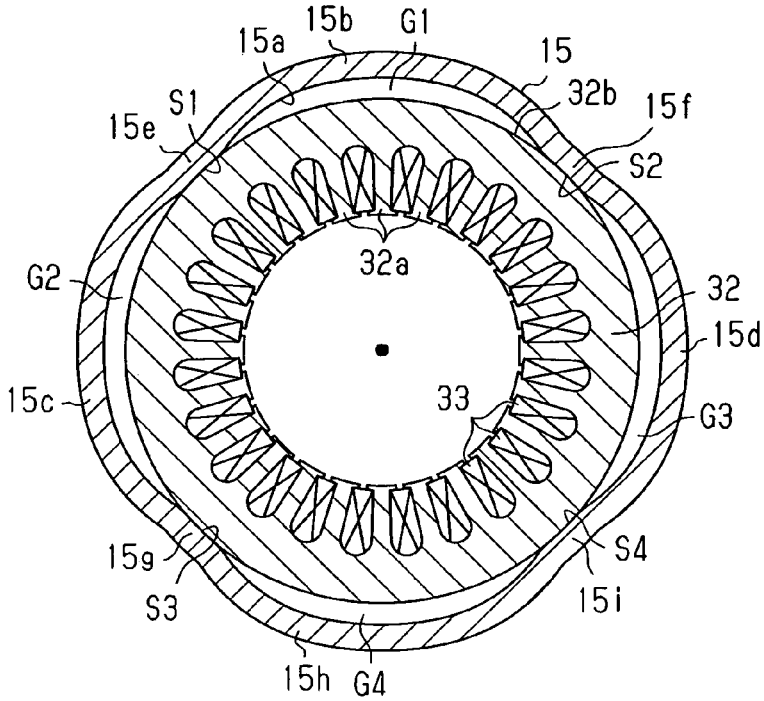
FIG. 5 is a partially omitted cross-sectional view showing a motor portion of a modification of the embodiment of the present invention.

The modification of FIG. 5 is different from the illustrated embodiment in the number of the expanded portions and that of the fastening interference portions. In FIG. 5, first to fourth expanded portions 15*b*, 15*c*, 15*d*, 15*h* are formed in the motor housing 15. Further, first to fourth fastening interference portions 15*e*, 15*f*, 15*g*, 15*i* are disposed between the corresponding adjacent ones of the expanded portions 15*b*, 15*c*, 15*d*, 15*h*. First to fourth fastening surfaces S1 to S4 are formed respectively in the first to fourth fastening interference portions 15*e*, 15*f*, 15*g*, 15*i*.

Thus, the outer circumferential surface 32*b* of the stator core 32 is fastened to the motor housing 15 at four positions corresponding to the first to fourth fastening surfaces S1 to S4. In this modification, before assembling the motor housing 15 with the stator core 32, the motor housing 15 is pressed from four directions corresponding to the expanded portions 15*b*, 15*c*, 15*d*, 15*h* at opposing vertical positions and opposing horizontal positions.

Figure 6A:
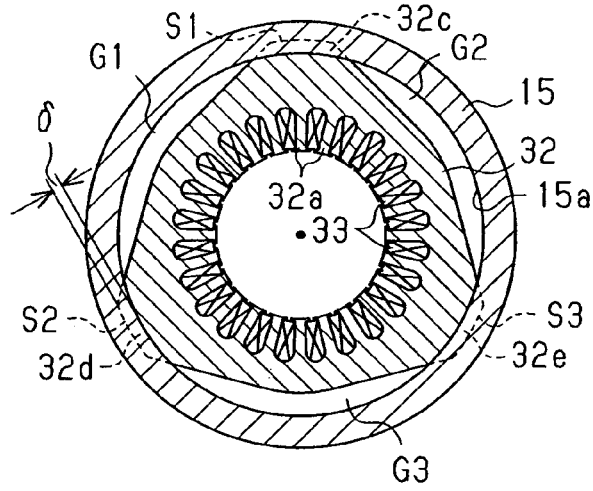
FIGS. 6(*a*) to 6(*c*) are cross-sectional views each showing a modification of the assembly method of the present invention.
Figure 6B:
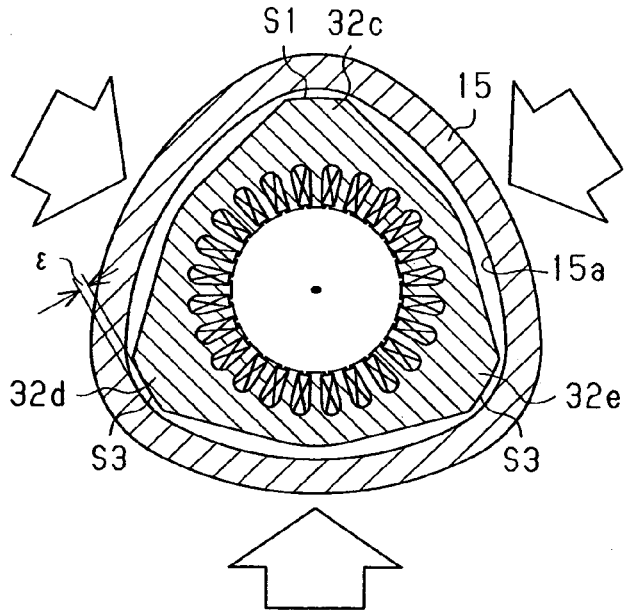
Figure 6C:
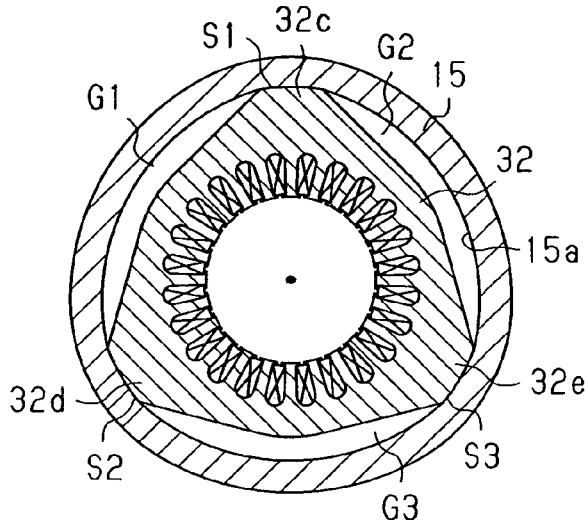

In the modification of FIGS. 6(*a*) to 6(*c*), the motor housing 15 has a cylindrical shape and the stator core 32 has a substantially triangle cross-sectional shape. First to third fastening interference portions 32*c*, 32*d*, 32*e* are each formed at an outer circumferential portion of the stator core 32. Referring to FIG. 6(*b*), the outer circumferential surface of the motor housing 15 is pressed at three positions, radially inward from the outer side. This expands the portions of the motor housing 15 corresponding to the first to third fastening interference portions 32*c* to 32*e* in radial outward directions.

As a result, a fitting interference ϵ is defined between each of the first to third fastening surfaces S1 to S3 of the first to third fastening interference portions 32*c* to 32*e* and the inner circumferential surface 15*a* of the motor housing 15. In this state, the stator core 32 is inserted into the motor housing 15 and the motor housing 15 is released from the pressed state of FIG. 6(*b*). Accordingly, with reference to FIG. 6(*c*), the motor housing 15 is deformed to restore the original cylindrical shape such that the motor housing 15 is pressed against the first to third fastening surfaces S1 to S3 of the first to third fastening interference portions 32*c* to 32*e* of the stator core 32. In this manner, the stator core 32 is fastened to the motor housing 15 in accordance with a predetermined fastening interference δ.

Each of the modifications of FIGS. 5 and 6 has the same advantages as those of the illustrated embodiment.

The present invention may be further modified as follows.

As long as a resulting fastening interference exceeds that of shrink fitting or shrink cooling, the motor housing 15 and the stator core 32 may be fastened together by different methods. The methods include, for example, mechanical deformation of either the motor housing 15 or the stator core 32 or both of the motor housing 15 and the stator core 32.

The motor housing 15 may be deformed by a different method other than pressing. For example, a plurality of tension tools may be employed at a plurality of positions of the outer circumferential surface of the motor housing 15. The tools thus apply tensile force to the motor housing 15, thus deforming the motor housing 15.

Further, for deforming the stator core 32, pressing or tension tools may be employed at a plurality of positions of the inner circumferential surface of the stator core 32. The tools thus apply pressing or tensile force to the stator core 32, thus deforming the stator core 32.

The method employed in the illustrated embodiment, the mechanical elastic deformation of the motor housing or the stator core 32 may be combined with the shrink fitting or shrink cooling.

Other different methods may be employed, the circumferential dimension of the inner circumferential surface 15*a* of the motor housing 15 may be larger than that of the outer circumferential surface 32*b* of the stator core 32 and the stator core 32 may be fastened to the motor housing 15 through deformation of the motor housing 15.

The motor housing 15 may be formed of a metal material other than aluminum that has a thermal expansion coefficient different than that of the iron material forming the stator core 32.

An increased number of expanded portions may be formed in the motor housing 15. However, for ensuring a predetermined fastening interference, it is preferred to deploy three to five expanded portions in the motor housing 15.

An increased number of fastening interference portions 32*c* to 32*e* may be formed in the stator core 32. However, for ensuring a predetermined fastening interference, it is preferred to deploy three to five fastening interference portions in the stator core 32.

Further, the motor housing 15 may be formed with an oval or triangle or square cross-sectional shape.

The present examples and embodiments are to be considered as illustrative and not restrictive and the invention is not to be limited to the details given herein, but may be modified within the scope and equivalence of the appended claims.

The invention claimed is:

1. A method of assembling a sealed type motor-driven compressor having a cylindrical motor housing formed of aluminum and an annular stator core fastened to the interior of the motor housing, the method comprising:

setting an inner circumferential shape of the motor housing and an outer circumferential shape of the stator core such that a predetermined fastening interference is defined between the motor housing and the stator core when the motor housing is separated from the stator core;

elastically deforming the motor housing by applying an external force to the motor housing for eliminating the fastening interference;

inserting the stator core into the motor housing with the motor housing held in the elastically deformed state; and releasing the external force from the motor housing with the stator core inserted into the motor housing for elastically restoring the motor housing to the original state such that the motor housing fastens the stator core.

2. A method of assembling a sealed type motor-driven compressor having a cylindrical motor housing and an annular stator core fastened to the interior of the motor housing, the method comprising:

fastening the stator core to the motor housing by mechanically deforming at least one of the motor housing and the stator core, the step of fastening the stator core to the motor housing includes:

setting an inner circumferential shape of the motor housing and an outer circumferential shape of the stator core such that a predetermined fastening interference is defined between the motor housing and the stator core when the motor housing is separated from the stator core;

elastically deforming the motor housing by applying an external force to the motor housing for eliminating the fastening interference;

inserting the stator core into the motor housing with the motor housing held in the elastically deformed state; and releasing the external force from the motor housing with the stator core inserted into the motor housing for elastically restoring the motor housing to the original state such that the motor housing fastens the stator core.

3. The method according to claim 2, wherein the fastening interference is larger than a fastening interference that can be defined in shrink fitting or shrink cooling of the stator core and the motor housing.

4. The method according to claim 2, wherein the stator core is formed of iron type material, and wherein the motor housing is formed of a metal having a thermal expansion coefficient different from that of iron type material.

5. The method according to claim 4, wherein the motor housing is formed by forging aluminum.

* * * * *